US008974634B2

(12) United States Patent
Yano et al.

(10) Patent No.: US 8,974,634 B2
(45) Date of Patent: Mar. 10, 2015

(54) CELLULOSE NANOFIBERS

(75) Inventors: Hiroyuki Yano, Uji (JP); Tadafumi Hashimoto, Uji (JP); Akihiro Sato, Kyoto (JP)

(73) Assignees: Nippon Paper Industries Co., Ltd., Tokyo (JP); Oji Holdings Corporation, Tokyo (JP); Mitsubishi Chemical Corporation, Tokyo (JP); Kyoto University, Kyoto-shi (JP)

( * ) Notice: Subject to any disclaimer, the term of this patent is extended or adjusted under 35 U.S.C. 154(b) by 29 days.

(21) Appl. No.: 13/512,965

(22) PCT Filed: Nov. 12, 2010

(86) PCT No.: PCT/JP2010/070224

§ 371 (c)(1),
(2), (4) Date: Jul. 19, 2012

(87) PCT Pub. No.: WO2011/068023

PCT Pub. Date: Jun. 9, 2011

(65) Prior Publication Data

US 2012/0277351 A1 Nov. 1, 2012

(30) Foreign Application Priority Data

Dec. 1, 2009 (JP) ..... 2009-273158

(51) Int. Cl.

| | |
|---|---|
| ***D21C 3/22*** | (2006.01) |
| ***D21D 1/34*** | (2006.01) |
| ***D21H 11/18*** | (2006.01) |

(52) U.S. Cl.
CPC . *D21D 1/34* (2013.01); *D21H 11/18* (2013.01)
USPC ..... 162/57; 524/35; 536/56

(58) Field of Classification Search
USPC ..... 162/57; 524/35; 536/56
See application file for complete search history.

(56) References Cited

U.S. PATENT DOCUMENTS

| | | | | |
|---|---|---|---|---|
| 4,496,427 | A * | 1/1985 | Davison | 162/157.5 |
| 5,620,562 | A * | 4/1997 | Marcoccia et al. | 162/42 |
| 7,378,149 | B2 * | 5/2008 | Yano et al. | 428/393 |
| 2012/0094953 | A1 * | 4/2012 | Gane et al. | 514/57 |

FOREIGN PATENT DOCUMENTS

| | | | |
|---|---|---|---|
| GB | 1229894 | A | 4/1971 |
| JP | 2007-100246 | A | 4/2007 |
| JP | 2007-231438 | A | 9/2007 |
| JP | 2007-262594 | A | 10/2007 |
| JP | 2008-075214 | A | 4/2008 |
| JP | 2009-019200 | A | 1/2009 |
| WO | WO 2007136086 | A1 * | 11/2007 |
| WO | WO 2008123419 | A1 * | 10/2008 |
| WO | WO 2010112519 | A1 * | 10/2010 |

OTHER PUBLICATIONS

Lee, S.-H., et al., "Enhancement of enzymatic accessibility by fibrillation of woody biomass using batch-type kneader with twin-screw elements," Bioresource Technol., 2010, 101, 769-774. Published online on Sep. 18, 2009.*

Dissolver discs, catalog, product description. downloaded from www.vma-getzmann.com on Apr. 12, 2013.*

International Search Report dated Feb. 15, 2011, issued for PCT/JP2010/070224.

Machinery and Equipment for Pulp and Paper Industry, the 2nd Edition, Textbook for Colleges and Universities (2003).

* cited by examiner

*Primary Examiner* — Liam J Heincer
*Assistant Examiner* — Nicholas Hill
(74) *Attorney, Agent, or Firm* — Locke Lord LLP; James E. Armstrong, IV; Nicholas J. DiCeglie, Jr.

(57) ABSTRACT

The present invention provides a novel production method of a cellulose nanofiber and a novel cellulose nanofiber. The method for producing a cellulose nanofiber comprises defibrating pulp by a single- or multi-screw kneader in the presence of water, the single or multi-screw kneader having a screw circumferential speed of 45 m/min. Or more.

3 Claims, 5 Drawing Sheets

CELLULOSE NANOFIBERS

TECHNICAL FIELD

The present invention relates to a cellulose nanofiber.

BACKGROUND ART

Cellulose nanofibers are a basic skeleton material (basic element) of all plants. In plant cell walls, cellulose nanofibers are present in the form of a bundle of several cellulose microfibrils (single cellulose nanofibers) having a width of about 4 nm.

Various methods are known as a method of producing cellulose nanofibers from plant fibers, etc. Generally, cellulose nanofibers are produced by defibrating or breaking up a cellulose fiber-containing material such as pulp by milling or beating, using devices such as a refiner, a grinder (stone-type grinder), a twin-screw kneader (twin-screw extruder), or a high-pressure homogenizer.

It is known that when the assembly of the cellulose nanofibers obtained by these methods is formed into a sheet, or when the cellulose nanofibers are mixed with resin to form a resin composite, the strength of the sheet or resin composite increases as the ratio (aspect ratio) of the fiber length to the fiber diameter (width) of the cellulose nanofiber increases. For example, Japanese Examined Patent Publication No. S48-6641 and Japanese Examined Patent Publication No. S50-38720 disclose a method of forming microfibril fibers utilizing a hydrophilic property, which is a feature of pulp or a cellulose fiber to obtain a cellulose-based fiber having a high aspect ratio. In these references, microfibril fibers are obtained by highly and repeatedly milling or beating up pulp using a refiner, and additionally a homogenizer, etc.

On the other hand, when pulp is defibrated, defibration is generally performed in the presence of water. After defibration, the water drainage time to separate water and the resulting cellulose nanofibers lengthens as the aspect ratio of the cellulose nanofibers increases. Specifically, to obtain a cellulose nanofiber sheet or cellulose nanofiber resin composite having a high strength, it is desirable to defibrate cellulose nanofibers having a high aspect ratio. However, when the fiber diameter is small and the aspect ratio is large, the water drainage time lengthens, which increases costs from an industrial viewpoint.

For example, in Patent Literature 1, absorbent cotton is defibrated by a high-pressure homogenizer to obtain a microfibrillated cellulose. However, when a starting material fiber, such as pulp, is defibrated by a high-pressure homogenizer, the fiber diameter is generally reduced to increase the aspect ratio. Therefore, although the high sheet strength can be obtained the water drainage time in the production of the cellulose nanofiber sheet becomes extremely long, which is not industrially preferable.

Patent Literature 2 discloses a method of defibrating pulp using a grinder or a twin-screw extruder. When milling is performed by a grinder, the fiber diameter is generally reduced to increase the aspect ratio; therefore, the sheet strength can be increased. However, this method also requires a relatively long water drainage time, and it is therefore not industrially preferable. The defibration by a twin-screw extruder is usually performed at a rotation speed of 200 to 400 rpm. (Since the screw diameter is 15 mm, the circumferential speed is 9.4 m/min. to 18.8 m/min.) For example, in Patent Literature 2, defibration is performed for 60 minutes at 400 rpm (circumferential speed: 18.8 m/min.). However, under such conditions, a high shear rate is not applied to pulp, and breakage of fiber advances preferentially over fiber defibration; therefore, microfibrillation (nanofiber formation) is insufficient, and it is difficult to obtain a nanofiber having high sheet strength.

In Patent Literature 3, pulp subjected to preliminary defibration using a refiner is defibrated using a twin-screw extruder at a screw rotation speed of 300 rpm, (Since the screw diameter is 15 mm, the circumferential speed is 14.1 m/min.), thus performing fine fibrillation. However, as described above, under such conditions, a high shear rate is not applied to pulp, and breakage of fiber advances preferentially over fiber defibration; therefore, microfibrillation (nanofiber formation) is insufficient, and it is difficult to obtain a nanofiber having high sheet strength.

CITATION LIST

Patent Literature

PTL 1: Japanese Unexamined Patent Publication No. 2007-231438

PTL 2: Japanese Unexamined Patent Publication No. 2009-19200

PTL 3: Japanese Unexamined Patent Publication No. 2008-75214

SUMMARY OF INVENTION

Technical Problem

A main object of the present invention is to provide a novel production method of a cellulose nanofiber and a novel cellulose nanofiber.

Solution to Problem

As described above, it is known that when cellulose is defibrated by a high-pressure homogenizer, etc., since the fiber diameter is reduced to increase the aspect ratio, high sheet strength can be obtained; however, the water drainage time in the formation of the cellulose nanofiber sheet is relatively prolonged. Further, it is difficult to obtain a nanofiber having a high sheet strength by defibration using a conventional twin-screw kneader. This indicates that it is extremely difficult to obtain both a good water filtering property and sufficient sheet strength. However, as a result of extensive research to solve the above object, the present inventors found the following:

In the production of a cellulose nanofiber by defibrating pulp using a single- or multi-screw kneader in the presence of water, by defibrating pulp at an extremely high shear rate, i.e., a circumferential speed of a kneader screw of 45 m/min. or more, which is beyond the scope of the conventional art, it is possible to obtain a cellulose nanofiber having an excellent water filtering property, as well as an excellent sheet strength, which is considered a property contradictory to the excellent water filtering property. Specifically, the present invention provides a cellulose nanofiber production method, a cellulose nanofiber, a sheet containing the fiber, and a composite of the fiber and the resin, all shown in the following Items 1 to 7.

Item 1

A method for producing a cellulose nanofiber comprising defibrating pulp by a single- or multi-screw kneader in the presence of water, the single or multi-screw kneader having a screw circumferential speed of 45 m/min. or more.

Item 2

The method according to Item 1, wherein the single- or multi-screw kneader is a twin-screw kneader.

Item 3

A cellulose nanofiber obtained by the method according to Item 1 or 2.

Item 4

A cellulose nanofiber obtained by the method according to Item 1 or 2, wherein the nanofiber has a following formula (1);

$$Y>0.1339X+58.299 \quad (1)$$

wherein X represents a drainage time (sec.) required to obtain a dewatered sheet (water-drained sheet) by filtering 600 mL of a slurry in which the concentration of a cellulose nanofiber in a mixture of the cellulose nanofiber and water is 0.33 wt %, under the following conditions:

(1) 20° C., (2) a filtration area of 200 $cm^3$, (3) a reduced pressure of −30 kPa, and (4) a filter paper having a mesh size of 7 μm and a thickness of 0.2 mm, and Y represents a tensile strength (MPa) of a 100 $g/m^2$ dry sheet obtained by hot-pressing a dewatered sheet (water-drained sheet) at 110° C., and a pressure of 0.003 MPa, for 10 minutes.

Item 5

A cellulose nanofiber, wherein the nanofiber has a following formula (1);

$$Y>0.1339X+58.299 \quad (1)$$

wherein X represents a drainage time (sec.) required to obtain a dewatered sheet (water-drained sheet) by filtering 600 mL of a slurry in which the concentration of a cellulose nanofiber in a mixture of the cellulose nanofiber and water is 0.33 wt %, under the following conditions:

(1) 20° C., (2) a filtration area of 200 $cm^3$, (3) a reduced pressure of −30 kPa, and (4) a filter paper having a mesh size of 7 μm and a thickness of 0.2 mm, and Y represents a tensile strength (MPa) of a 100 $g/m^2$ dry sheet obtained by hot-pressing a dewatered sheet (water-drained sheet) at 110° C., and a pressure of 0.003 MPa, for 10 minutes.

Item 6

A sheet containing the cellulose nanofiber according to any one of Items 3 to 5.

Item 7

A resin composite containing the cellulose nanofiber according to any one of Items 3 to 5.

Hereinafter, a cellulose nanofiber production method, a cellulose nanofiber, a sheet containing the cellulose nanofiber, and a composite of the fiber and a resin in the present invention are detailed.

1. Production Method

The method for producing a cellulose nanofiber of the present invention has a feature in that when pulp is defibrated by a single- or multi-screw kneader in the presence of water to produce a cellulose nanofiber, the screw circumferential speed of the kneader is set to 45 m/min. or more.

Starting Material Pulp

Examples of the pulp subjected to defibration in the present invention include chemical pulp such as kraft pulp, sulphite pulp, soda pulp, and sodium carbonate pulp; mechanical pulp; chemiground pulp; recycled pulp recycled from used paper, etc. These pulps can be used singly or in a combination of two or more. Of these pulps, kraft pulp is particularly preferable from the viewpoint of strength.

Examples of the raw materials of the pulp include wood-based cellulose raw materials such as softwood chips, hardwood chips, and sawdust; and non-wood-based cellulose raw materials (e.g., annual plants such as bagasse, kenaf, straw, reed, and esparto). Of the raw materials of the pulp, wood-based cellulose raw materials, particularly, softwood chips and hardwood chips are preferable, and softwood unbleached kraft pulp (NUKP) and softwood bleached kraft pulp (NBKP) are the most preferable raw material pulp.

Single- or Multi-Screw Kneader

In the present invention, the cellulose nanofiber can be produced by defibrating the raw material pulp by a single- or multi-screw kneader (hereinbelow, sometimes simply referred to as a "kneader"). Examples of the kneader (kneading extruder) include a single-screw kneader or a multi-screw kneader having two or more screws. In the present invention, either can be used. The use of the multi-screw kneader is preferable because the dispersion property of the raw material pulp and the degree of the nanofiber formation can be improved. Of the multi-screw kneaders, a twin-screw kneader is preferable because it is readily available.

In the present invention, the lower limit of the screw circumferential speed of the single- or multi-screw kneader is about 45 m/min. The lower limit of the screw circumferential speed is preferably about 60 m/min., and particularly preferably about 90 m/min. The upper limit of the screw circumferential speed is generally about 200 m/min., preferably about 150 m/min., and particularly preferably about 100 m/min. In the present invention, by setting the screw circumferential speed to 45 m/min., the fiber surface can be fibrillated at a higher shear rate than in the past, and high sheet strength can be obtained even though the water drainage time is short.

As described above, in the past, when a cellulose nanofiber was defibrated by a twin-screw kneader, the screw circumferential speed of the kneader was generally about 10 m/min. to 20 m/min. When defibration is performed at such a circumferential speed, the shear rate acting on cellulose decreases, and breakage of fiber advances preferentially over defibration. Accordingly, the defibration is not sufficiently performed, resulting in a cellulose nanofiber in which high sheet strength is not obtained.

The L/D (the ratio of the screw diameter D to the kneader length L) of the kneader used in the present invention is generally about 15 to 60, preferably about 30 to 60.

The defibration time of the single- or multi-screw kneader varies depending on the kind of the raw material pulp, the L/D of the kneader, and the like. When the L/D is in the aforementioned range, the defibration time is generally about 30 to 60 minutes, and preferably about 30 to 45 minutes.

The number of times defibration treatment (pass) of the pulp using the kneader varies depending on the fiber diameter and the fiber length of the target cellulose nanofiber, the L/D of the kneader, or the like; however, it is generally about 1 to 8 times, and preferably about 1 to 4 times. When the number of defibrations (passes) of the pulp by the kneader is too high, although the defibration proceeds, cellulose becomes discolored due to heat generation, which leads to heat damage (decrease in the sheet strength).

The kneader includes one or more kneading members, each having a screw.

When there are two or more kneading members, one or more blocking structures) (traps) may be present between the kneading members. In the present invention, since the screw circumferential speed is 45 m/min. or more, which is much higher than the conventional screw circumferential speed, it is preferable not to include the blocking structure to decrease the load to the kneader.

The rotation directions of the two screws that compose a twin-screw kneader are either the same or different. The two screws composing a twin-screw kneader may be complete-engagement screws, incomplete-engagement screws, or non-engagement screws. In the defibration of the present invention, complete-engagement screws are preferably used.

The ratio of the screw length to the screw diameter (screw length/screw diameter) may be about 20 to 150. Examples of the twin-screw kneader include KZW produced by Technovel Ltd., TEX produced by the Japan Steel Works Ltd., ZSK produced by Coperion GmbH, and the like.

The proportion of the raw material pulp in the mixture of water and the raw material pulp subjected to defibration is generally about 10 to 70 wt %, and preferably about 20 to 50 wt %.

The temperature in the kneading is not particularly limited. It is generally 10 to 160° C., and particularly preferably 20 to 140° C.

In the present invention, the raw material pulp may be subjected to preliminary defibration using a refiner, etc., before defibrated using the kneader. Conventionally known methods can be used as a method of preliminary defibration using a refiner, etc.; for example, the method described in Patent Literature 3 can be used. By performing preliminary defibration using a refiner, the load applied to the kneader can be reduced, which is preferable from the viewpoint of production efficiency.

2. Cellulose Nanofiber

The cellulose nanofiber of the present invention has the following feature.

the nanofiber satisfies a following formula (1);

$$Y>0.1339X+58.299 \quad (1)$$

wherein X represents a drainage time (sec.) required to obtain a dewatered sheet (water-drained sheet) by filtering 600 mL of a slurry in which the concentration of a cellulose nanofiber in a mixture of the cellulose nanofiber and water is 0.33 wt %, under the following conditions:

(1) 20° C., (2) a filtration area of 200 $cm^3$, (3) a reduced pressure of −30 kPa, and (4) a filter paper having a mesh size of 7 μm and a thickness of 0.2 mm, and Y represents a tensile strength (MPa) of a 100 $g/m^2$ dry sheet obtained by hot-pressing a dewatered sheet (water-drained sheet) at 110° C., and a pressure of 0.003 MPa, for 10 minutes.

Specifically, as shown in the graph of FIG. 1, the cellulose nanofiber of the present invention has a feature in that the value Y is in the range higher than the straight line represented by the formula (1c):

$$Y=0.1339X+58,299 \quad (1c).$$

The above relation formula can be obtained as follows.

In the production of a cellulose nanofiber, the approximated curve of the formula (1a) below can be obtained (FIG. 1) from the results of Comparative Examples 1 to 4, in which sheets were obtained by a production method using a conventional twin-screw kneader.

$$Y=0.1339X+47.871 \quad (1a)$$

On the other hand, in the production of cellulose nanofibers, from the results of Examples 1 to 4, in which sheets were obtained by a production method using a conventional twin-screw kneader, the approximated curve of the formula (1b) can be obtained (FIG. 1).

$$Y=0.1339X+68.727 \quad (1b)$$

The line between the lines represented by formula (1a) and (1b) is the line represented by formula (1c). The region higher than line (1c) is the relation formula represented by formula (1) described above. For example, when the water drainage time is 200 seconds in the line represented by formula (1c) in FIG. 1, the tensile strength exceeds 80 MPa. On the other hand, the line represented by formula (1a) in FIG. 1 indicates that defibration is required until the water drainage time largely extends to about 300 seconds, to obtain a sheet having a tensile strength of 80 MPa according to the defibration method of the Comparative Examples. When the water drainage time for obtaining a sheet having the same strength is increased to 1.5 times, this will be a remarkable disadvantage in producing a sheet on a large industrial scale.

The upper limit of the water drainage time X (sec.) varies depending on the target sheet strength. From the industrial viewpoint, it is generally about 10 to 2000 seconds, and preferably about 10 to 200 seconds. As the water drainage time lengthens, the speed of the cellulose nanofiber for forming a sheet decreases, which is not preferable.

The upper limit of the tensile strength Y (MPa) of the sheet varies depending on the kind of pulp, etc.; however, it is generally about 20 to 200 MPa, and preferably about 50 to 200 MPa. For example, in the case of kraft pulp, it is about 50 to 200 MPa, and preferably about 80 to 200 MPa.

In the present invention, the water drainage time is the time required to obtain a dewatered sheet by subjecting 600 mL of a slurry that contains water and a 0.33 wt % cellulose nanofiber to suction filtration under reduced pressure and the aforementioned conditions (1) to (4). In the present invention, the dewatered sheet indicates a sheet of a cellulose nanofiber formed by the suction filtration, in which almost no droplets are generated. When the formation of the dewatered sheet is insufficient and water is left on the sheet, the sheet appears shiny by light reflection. Since light is not reflected once the dewatered sheet is formed, the formation of the dewatered sheet can be confirmed by this phenomenon. In addition, although almost no water droplets are generated after the formation of the dewatered sheet, a slight amount of water droplets contained in the dewatered sheet may occur.

The water amount in the dewatered sheet after water filtration is preferably low from the viewpoint of drying load mitigation.

The aforementioned water drainage time is obtained by performing the aforementioned measurement several times and calculating the average thereof. After the dewatered sheet is formed, since there is no slurry to be sucked, air suction starts. Since the air suction makes a noise, the formation of the dewatered sheet can be confirmed by this noise.

As described above, in the case where the assembly of cellulose nanofibers is formed into a sheet, or the cellulose nanofibers and resin are mixed to form a resin composite, the strength of the sheet and the resin composite is generally hard when the fiber diameter (width) of the cellulose nanofiber is small and the aspect ratio is large.

On the other hand, when pulp is defibrated, defibration is generally performed in the presence of water. After defibration, the water drainage time to separate water and cellulose nanofiber lengthens as the fiber diameter of the cellulose nanofiber decreases. Specifically, as is clear from the graph of FIG. 1, the water drainage time and the strength of the sheet containing of a cellulose nanofiber have a linear relationship.

Thus, to obtain a sheet of a cellulose nanofiber having a high strength or a resin composite, it is desirable that defibration be performed to obtain a cellulose nanofiber having a small fiber diameter; however, as the fiber diameter decreases, the water drainage time in the production process lengthens, which increases cost from the industrial viewpoint.

In contrast, in the present invention, cellulose nanofibers having a small fiber diameter (about 15 to 20 nm) and cellulose nanofibers having a relatively large fiber diameter (about 300 to 1000 nm) are mixed (FIG. 2). Further, compared to grinder treatment, etc., damage to the cellulose nanofiber surface caused by defibration is small, and the aspect ratio of the cellulose nanofiber is large. Accordingly, the cellulose nanofiber of the present invention has non-conventional properties that the strength is high even though the water drainage time is short. Further, since the cellulose nanofiber of the present invention partially includes fibers having a size of about 1 to 10 μm, this apparently also contributes to the excellent effect of the present invention, i.e., short drainage time despite high strength.

The cellulose nanofiber of the present invention also includes fibers that are defibrated to even cellulose microfibrils (single cellulose nanofibers) having a width of about 4 nm.

On the other hand, the cellulose nanofiber obtained by defibration using a refiner includes many cellulose nanofibers having a large fiber diameter due to insufficient defibration (see FIG. 3). The sheet obtained from such cellulose nanofibers has a low strength even though the water drainage time is short. The defibration conditions using the refiner were determined based on performing breaking to the level at which the Canadian Standard Freeness (CSF) indicates 50 mL.

As is clear from the results of Comparative Example 5, when pulp is defibrated by a high-pressure homogenizer, although the cellulose nanofiber having an extremely small fiber diameter (FIG. 4) can be obtained, the drainage time becomes relatively long. Further, when defibration is performed under conventional twin-screw conditions (screw circumferential speed of about 9.4 m/min. to 18.8 m/min.), a high shearing force is not applied to pulp, and breakage of fiber advances preferentially over fiber defibration. Therefore, microfibrillation (nanofiber formation) is insufficient, and it is difficult to obtain a nanofiber having high sheet strength (see FIG. 5).

The cellulose nanofiber of the present invention satisfying the above relation formula (1) can be produced by defibrating pulp by the production process of the present invention.

The fiber diameter of the cellulose nanofiber of the present invention is about 4 to 400 nm, preferably 4 to 200 nm, and particularly preferably about 4 to 100 nm on average. Further, the fiber length is about 50 nm to 50 μm, preferably about 100 nm to 10 μm on average.

The average values of the fiber diameter and the fiber length of the cellulose nanofiber of the present invention are obtained by measuring 100 cellulose nanofibers in the view of an electron microscope.

3. Sheet

As described above, the cellulose nanofiber of the present invention can be formed into a molded product that is in the form of a sheet. Although the forming process is not particularly limited, the mixture (slurry) of water and the cellulose nanofiber obtained by the defibration is, for example, subjected to suction filtration, and a sheet-like cellulose nanofiber on the filter is dried and subjected to hot pressing, thus forming a cellulose nanofiber on the sheet.

When the cellulose nanofiber is formed into a sheet, the concentration of the cellulose nanofiber in the slurry is not particularly limited. The concentration is generally about 0.1 to 2.0 wt %, and preferably about 0.2 to 0.5 wt %.

Further, the reduced degree of the suction filtration is generally about 10 to 60 kPa, and preferably about 10 to 30 kPa. The temperature at the suction filtration is generally about 10 to 40° C., and preferably about 20 to 25° C.

A wire mesh cloth, filter paper, etc., can be used as a filter. The mesh size of the filter is not particularly limited as long as the cellulose nanofiber after defibration can be filtered. In the case of using a wire mesh, those having a mesh size of about 1 to 100 μm can be generally used; and in the case of using a filter paper, those having a mesh size of about 1 to 100 μm can be generally used.

By the above suction filtration, the dewatered sheet (wet web) of the cellulose nanofiber can be obtained. When the obtained dewatered sheet is subjected to hot pressing, the dry sheet of the cellulose nanofiber can be obtained.

The heating temperature in the hot pressing is generally about 50 to 150° C., preferably about 90 to 120° C. The pressure is generally about 0.0001 to 0.05 MPa, and preferably about 0.001 to 0.01 MPa. The hot pressing time is generally about 1 to 60 minutes, and preferably about 10 to 30 minutes.

The tensile strength of the sheet obtained by the cellulose nanofiber of the present invention varies depending on the basis weight, density, etc., of the sheet. In the present invention, a sheet having a basis weight of 100 $g/m^2$ is formed, and the tensile strength of the cellulose nanofiber sheet obtained from the cellulose nanofiber having a density of 0.8 to 1.0 $g/cm^3$ is measured. The tensile strength is the value measured by the following method. The dried cellulose nanofiber sheet that is prepared to have a basis weight of 100 $g/m^2$ is cut to form a rectangular sheet having a size of 10 mm×50 mm, thus obtaining a specimen. The specimen is mounted on a tensile tester, and the strain and the stress applied on the specimen are measured while adding load. The load applied per specimen unit sectional area when the specimen is ruptured is referred to as tensile strength.

4. Resin Composite

The cellulose nanofiber of the present invention can be mixed with various resins to form a resin composite.

The resin is not particularly limited, and the following resins can be used. Thermoplastic resins including polylactic acid; polybutylene succinate; vinyl chloride resin; vinyl acetate resin; polystyrene; ABS resin; acrylic resin; polyethylene; polyethylene terephthalate; polypropylene; fluorine resin; amido resin; acetal resin; polycarbonate; cellulose plastic; polyesters such as polyglycolic acid, poly-3-hydroxybutyrate, poly-4-hydroxybutyrate, polyhydroxyvalerate polyethylene adipate, polycaprolactone, and polypropiolactone; polyethers such as polyethylene glycol; polyamides such as polyglutamic acid and polylysine; and polyvinyl alcohol; and thermoplastic resins including phenolic resin; urea resin; melamine resin; unsaturated polyester resin; epoxy resin; diallyl phthalate resin; polyurethane resin; silicone resin; and polyimide resin. These are non-limiting examples, and the resin can be used singly or in a combination of two or more. Among these, biodegradable resins such as polylactic acid and polybuthylene succinate; polyolefine resins such as polyethylene and polypropylene; phenolic resins; epoxy resins; and unsaturated polyester resins are preferable.

Examples of the biodegradable resins include homopolymers, copolymers, and polymer mixtures of compounds such as L-lactic acid, D-lactic acid, DL-lactic acid, glycolic acid, malic acid, succinic acid, ϵ-caprolactone, N-methylpyrrolidone, trimethylene carbonate, p-dioxanone, 1,5-dioxepan-2-one, hydroxybutyrate, and hydroxyvalerate. These may be used singly or in a combination of two or more. Among these biodegradable resins, polylactic acid, polybutylene succinate, and polycaprolactone are preferable, polylactic acid, and polybutylene succinate are more preferable.

The method of forming a composite of a cellulose nanofiber and a resin cannot be particularly limited, and a general method of forming a composite of a cellulose nanofiber and a resin can be used. Examples thereof include a method in which a sheet or molded product formed of a cellulose nanofiber is sufficiently impregnated with a resin monomer liquid, followed by polymerization using heat, UV irradiation, a polymerization initiator, etc.; a method in which a cellulose nanofiber is sufficiently impregnated with a polymer resin solution or resin powdery dispersion, followed by drying; a method in which a cellulose nanofiber is sufficiently dispersed in a resin monomer composition, followed by polymerization using heat, UV irradiation, a polymerization initiator, etc.; a method in which a cellulose nanofiber is sufficiently dispersed in a polymer resin solution or a resin powdery dispersion, followed by drying; and a method in which a cellulose nanofiber is subjected to kneading dispersion in a thermal fusion resin composition, followed by press molding, extrusion molding, or injection molding, etc.

The proportion of the cellulose nanofiber in the composite is preferably about 10 to 90 wt %, and more preferably about 10 to 50 wt %. By adjusting the proportion of the cellulose nanofiber to the above range, a light, high-strength molding material can be obtained.

To form a composite, the following additives can be added: surfactants; polysaccharides such as starch and alginic acid; natural proteins such as gelatin, hide glue, and casein; inorganic compounds such as tannin, zeolite, ceramics, and metal powders; colorants; plasticizers; fragrances; pigments; fluidity adjusters; leveling agents; conducting agents; antistatic agents; ultraviolet absorbers; ultraviolet dispersants; and deodorants.

Thus, the resin composite of the present invention can be produced. According to the cellulose nanofiber of the present invention, since the strength is high despite the short water drainage time, a high-strength resin composite can be attained as well as reducing costs in the production process of the resin composite. This composite resin can be molded like other moldable resins, and for example, molding can be performed by extrusion molding, injection molding, hot pressing by metal molding, etc. The molding conditions of the resin composite can be applied by suitably adjusting the molding conditions of the resin, as necessary.

The resin composite of the present invention has high mechanical strength; therefore, it can be used in fields requiring higher mechanical strength (tensile strength, etc.) in addition to fields in which conventional cellulose nanofiber molded products and conventional cellulose nanofiber-containing resin molded products are used. For example, the invention is applicable to interior materials, exterior materials, and structural materials of transportation vehicles such as automobiles, trains, ships, and airplanes; the housings, structural materials, and internal parts of electrical appliances such as personal computers, televisions, telephones, and watches; the housings, structural materials, and internal parts of mobile communication equipment such as cell phones; the housings, structural materials, and internal parts of devices such as portable music players, video players, printers, copiers, and sporting equipment; building materials; and office supplies such writing supplies.

Advantageous Effects of Invention

In the production of a cellulose nanofiber by defibrating pulp using a single- or multi-screw kneader in the presence of water, by defibrating pulp at an extremely high shear rate, i.e., a circumferential speed of a kneader screw of 45 m/min. or more, which is beyond the scope of the prior art, the present invention can provide a cellulose nanofiber having an excellent water filtering property, as well as excellent sheet strength, which is considered a property contradictory to the excellent water filtering property.

EXAMPLE 1

Figure 1:
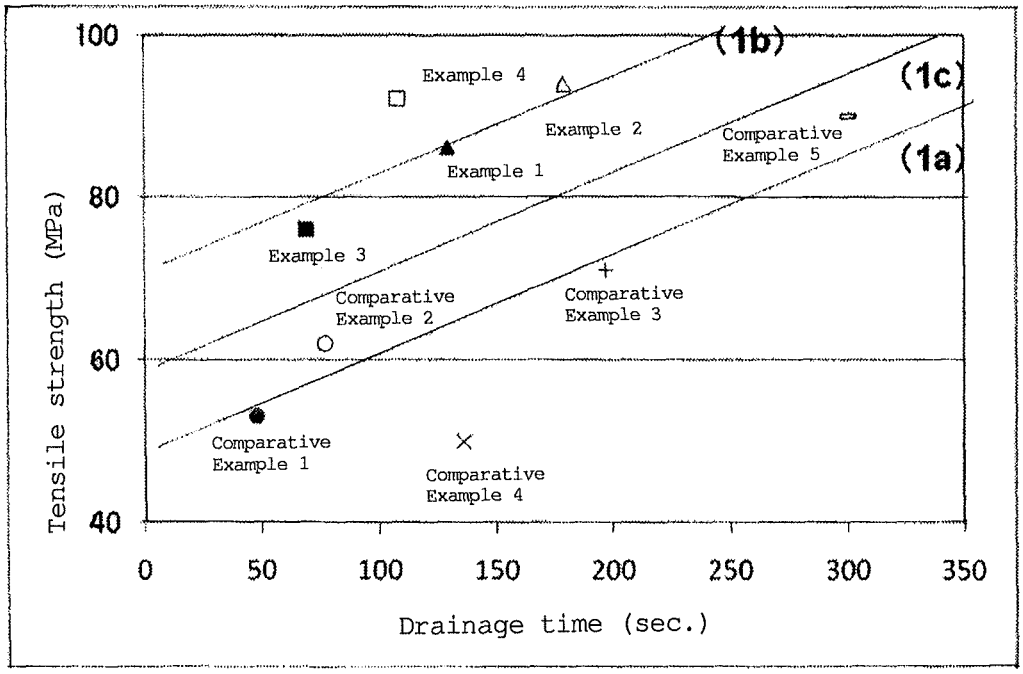
FIG. 1 is a graph showing the relationship between the drainage time and tensile strength of the sheets obtained in Examples 1 to 4 and Comparative Examples 1 to 5.
Figure 2:
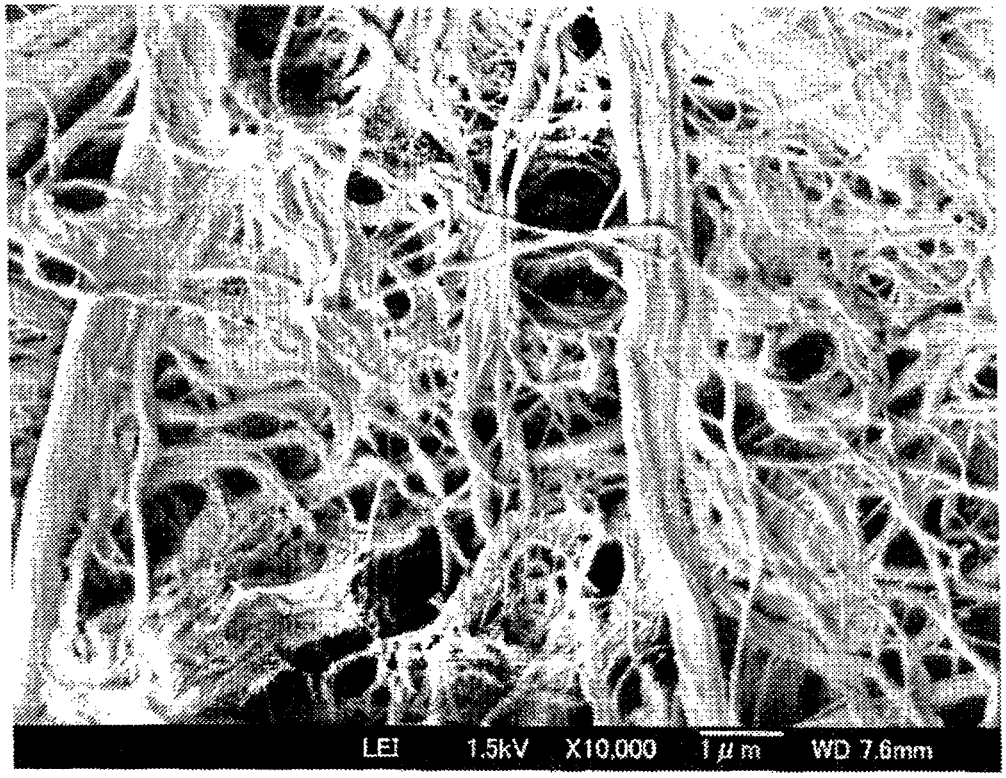
FIG. 2 is a scanning electron micrograph of the cellulose nanofibers obtained in Example 1.
Figure 3:
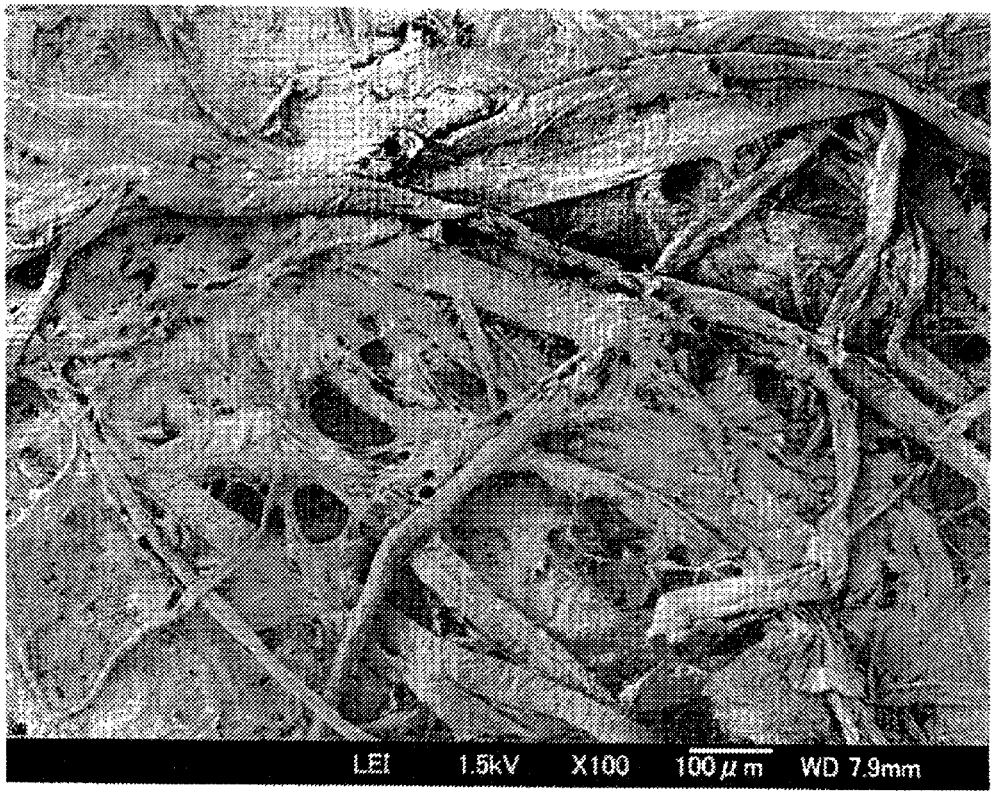
FIG. 3 is a scanning electron micrograph of the cellulose nanofibers obtained by refiner treatment.
Figure 4:
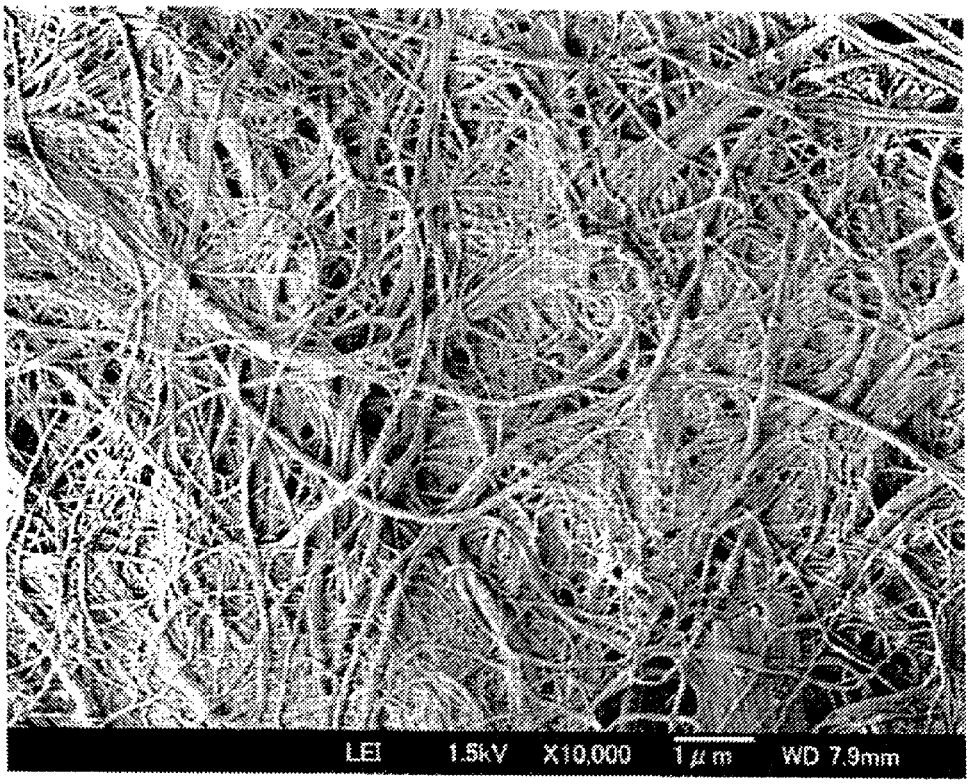
FIG. 4 is a scanning electron micrograph of commercially available cellulose nanofibers (CELISH: a product of Daicel Chemical Industries, Ltd.).
Figure 5:
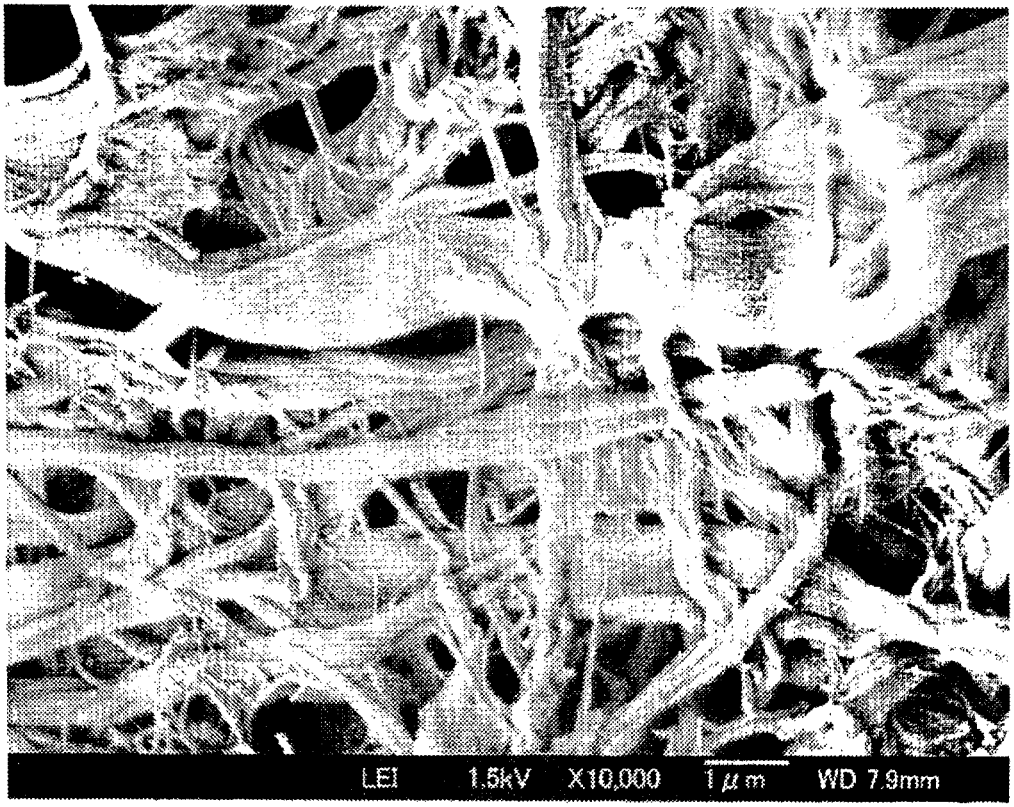
FIG. 5 is a scanning electron micrograph of the cellulose nanofibers obtained in Comparative Example 3.

A slurry of softwood unbleached kraft pulp (NUKP) (an aqueous suspension with a pulp slurry concentration of 2 wt %) was passed through a single disc refiner (a product of Kumagai Riki Kogyo Co., Ltd.) and repeatedly subjected to refiner treatment until a Canadian standard freeness (CSF) value of 100 mL or less was achieved. Subsequently, using a centrifugal dehydrator (a product of Kokusan Co., Ltd.), the obtained slurry was dehydrated and concentrated to a pulp concentration of 25 wt % at 2000 rpm for 15 minutes. The obtained wet pulp was introduced into a twin-screw kneader (KZW, a product of Technovel Corporation) and subjected to defibration treatment. The defibration was performed using the twin-screw kneader under the following conditions.

[Defibration Conditions]

Screw diameter: 15 mm

Screw rotation speed: 2000 rpm (screw circumferential speed: 94.2 m/min)

Defibration time: 150 g of softwood unbleached kraft pulp was subjected to defibration treatment under the conditions of 500 g/hr to 600 g/hr. The time from introduction of the starting material to obtaining of cellulose nanofibers was 15 minutes.

L/D: 45

Number of times defibration treatment was performed: once (1 pass)

Number of wall structures: 0.

Subsequently, water was added to the slurry obtained by defibration to adjust the cellulose nanofiber concentration to 0.33 wt %. The temperature of the slurry was adjusted to 20° C. After 600 mL of the slurry was placed into a jar and stirred with a stirring rod, filtration under reduced pressure was promptly initiated. The filtration conditions were as follows.

[Filtration Conditions]

Filtration area: about 200 $cm^2$

Vacuum: −30 kPa

Filter paper: 5A filter paper manufactured by Advantec Toyo Kaisha, Ltd.

Filtered amount: 600 mL of slurry having a cellulose nanofiber concentration of 0.33 wt %.

The time required from the start of filtration under reduced pressure to formation of a dewatered sheet (a wet web) was defined as drainage time Y (second). The obtained wet web was subjected to a hot pressing at 110° C. under a pressure of 0.003 MPa for 10 minutes to prepare a dry sheet having a weight per unit area of 100 $g/m^2$. The tensile strength of the obtained dry sheet was measured. Table 1 shows the physical property values of the obtained dry sheet. When moisture remains on the sheet, the sheet appears shiny due to reflection of light. In contrast, when a dewatered sheet is obtained, light reflection is lost. Accordingly, the time from the start of filtration under reduced pressure to the loss of light reflection was defined as drainage time. The drainage time was obtained by performing the measurement several times and calculating the average of the measurement values. The method of measuring the tensile strength was as described above.

EXAMPLE 2

A sheet was produced in the same manner as in Example 1, except that the number of times defibration treatment was performed was changed to four times (4 passes). Table 1 shows the physical property values of the obtained sheet.

EXAMPLE 3

A sheet was produced in the same manner as in Example 1, except that softwood bleached kraft pulp (NBKP) was used as the pulp instead of softwood unbleached kraft pulp (NUKP). Table 1 shows the physical property values of the obtained sheet.

EXAMPLE 4

A sheet was produced in the same manner as in Example 3, except that the number of times defibration treatment was performed was changed to four times (4 passes). Table 1 shows the physical property values of the obtained sheet.

COMPARATIVE EXAMPLE 1

A sheet was produced in the same manner as in Example 1, except that a circumferential screw speed of 18.8 m/min was used instead of 94.2 m/min. Table 1 shows the physical property values of the obtained sheet.

COMPARATIVE EXAMPLE 2

A sheet was produced in the same manner as in Comparative Example 1, except that the number of wall structures was 1 instead of 0. Table 1 shows the physical property values of the obtained sheet.

COMPARATIVE EXAMPLE 3

A sheet was produced in the same manner as in Comparative Example 1, except that the number of wall structures was 2 instead of 0. Table 1 shows the physical property values of the obtained sheet.

COMPARATIVE EXAMPLE 4

The softwood unbleached kraft pulp (NUKP) was mixed with water and fully stirred to prepare a suspension with a pulp concentration of 2 wt %. The obtained suspension was placed in a single disc refiner, and beaten to achieve a Canadian standard freeness (CSF) of 50 mL. Water was added to the obtained slurry to achieve a cellulose nanofiber concentration of 0.33 wt %. Thereafter, the same procedures as in Example 1 were repeated to produce a sheet. Table 1 shows the physical property values of the obtained sheet.

COMPARATIVE EXAMPLE 5

A sheet was produced in the same manner as in Comparative Example 4, except that CELISH (a product of Daicel Chemical Industries, Ltd., pulp consistency: 10%) was used. Table 1 shows the physical property values of the obtained sheet.

TABLE 1

| | Drainage time (second) | Tensile strength (MPa) |
|---|---|---|
| Example 1 | 129 | 85.6 |
| Example 2 | 179 | 90.0 |
| Example 3 | 69 | 76.6 |
| Example 4 | 108 | 92.2 |
| Comp. Ex. 1 | 48 | 53 |
| Comp. Ex. 2 | 77 | 61.5 |
| Comp. Ex. 3 | 197 | 71.4 |
| Comp. Ex. 4 | 114 | 50.6 |
| Comp. Ex. 5 | 300 | 91.2 |

EXAMPLE 5

A cellulose nanofiber slurry was prepared from an aqueous suspension of softwood unbleached kraft pulp (NUKP) under the same defibration conditions as in Example 2. The obtained slurry was filtered to produce a cellulose nanofiber sheet. The filtration conditions were as follows.

Filtration area: about 200 $cm^2$

Vacuum: −30 kPa

Filter paper: 5A manufactured by Advantec Toyo Kaisha, Ltd.

Subsequently, the obtained sheet was cut to a size of 30 mm width×40 mm length; and dried at 105° C. for 2 hours, after which the weight was measured. Further, the sheet was immersed in a resin solution prepared by adding 1 part by weight of benzoyl peroxide ("Nyper FF," a product of NOF Corporation) to 100 parts by weight of an unsaturated polyester resin ("SUNDHOMA FG-283," a product of DH Material Inc.). The immersion was performed under reduced pressure (vacuum: 0.01 MPa for 30 minutes), and an unsaturated polyester resin-impregnated sheet was obtained. Subsequently, 12 sheets of the same unsaturated polyester resin-impregnated sheet were stacked. After removing excess resin, the sheets were placed into a die and subjected to a hot press (at 90° C. for 30 minutes) to obtain a cellulose nanofiber-unsaturated polyester composite molded product. The weight of the obtained molded product was measured, and the fiber content (wt %) was calculated from the difference between the weight of the obtained molded product and the dry weight of the sheet.

The length and width of the molded product were precisely measured with a caliper (a product of Mitutoyo Corporation). The thickness was measured at several locations using a micrometer (a product of Mitutoyo Corporation) to calculate the volume of the molded product. The weight of the molded product was separately measured. The density was calculated from the obtained weight and volume.

A sample 1.2 mm in thickness, 7 mm in width, and 40 mm in length was prepared from the molded product. The flexural modulus and flexural strength of the sample were measured at a deformation rate of 5 mm/min (load cell 5 kN). An Instron Model 3365 universal testing machine (a product of Instron Japan Co., Ltd.) was used as a measuring apparatus. Table 2 shows the fiber content, density, and flexural strength of the resin composite obtained in Example 5.

COMPARATIVE EXAMPLE 6

A cellulose nanofiber slurry was prepared from an aqueous suspension of softwood unbleached kraft pulp (NUKP) under the same defibration conditions as in Comparative Example 3. An unsaturated polyester-cellulose nanofiber composite molded product was prepared from the obtained slurry in the same manner as in Example 5. Table 2 shows the fiber content, density, and flexural strength of the resin composite molded product obtained in Comparative Example 6.

TABLE 2

| Sample | Fiber content (%) | Density ($g/cm^3$) | Flexural strength (MPa) |
|---|---|---|---|
| Example 5 | 88.4 | 1.42 | 282 |
| Example 6 | 88.5 | 1.43 | 262 |

The invention claimed is:

1. A method for producing a cellulose nanofiber comprising defibrating pulp by a single- or multi-screw kneader in the presence of water, the single or multi-screw kneader having a screw circumferential speed of 45 meters per minute or more, and the L/D of the kneader is 15 or more, wherein L is the kneader length and D is the screw diameter.

2. The method according to claim 1, wherein the single- or multi-screw kneader is a twin-screw kneader.

3. The method according to claim 1, wherein the L/D of the kneader is 15 to 60.

* * * * *